US008446345B2

(12) United States Patent
Yu et al.

(10) Patent No.: US 8,446,345 B2
(45) Date of Patent: May 21, 2013

(54) ORGANIC LIGHT EMITTING DIODE DISPLAY

(75) Inventors: Sangho Yu, Gumi-si (KR); Kyoungdon Woo, Gumi-si (KR); Jaedo Lee, Gumi-si (KR); Youngjin Hong, Gumi-si (KR)

(73) Assignee: LG Display Co. Ltd., Seoul (KR)

( * ) Notice: Subject to any disclaimer, the term of this patent is extended or adjusted under 35 U.S.C. 154(b) by 896 days.

(21) Appl. No.: 12/574,997

(22) Filed: Oct. 7, 2009

(65) Prior Publication Data

US 2010/0085282 A1 Apr. 8, 2010

(30) Foreign Application Priority Data

Oct. 7, 2008 (KR) ..... 10-2008-0098317

(51) Int. Cl.
*G09G 3/30* (2006.01)

(52) U.S. Cl.
USPC ..... 345/76

(58) Field of Classification Search
USPC ..... 345/76; 375/351; 455/223
See application file for complete search history.

(56) References Cited

U.S. PATENT DOCUMENTS 6,072,355 A * 6/2000 Bledsoe ..... 327/390
2004/0201563 A1* 10/2004 Kobayashi ..... 345/100
2004/0257349 A1* 12/2004 Kobayashi ..... 345/204

* cited by examiner

*Primary Examiner* — William Boddie
*Assistant Examiner* — Andrew Schnirel
(74) *Attorney, Agent, or Firm* — Brinks Hofer Gilson & Lione

(57) ABSTRACT

An organic light emitting diode (OLED) display is disclosed. The OLED display includes a display panel including a plurality of pairs of data lines, a plurality of gate line groups crossing the pairs of data lines, and a plurality of pixels each having a drive thin film transistor (TFT) and an organic light emitting diode at each of crossings of the pairs of data lines and the gate line groups, a timing controller generating a non-overlap signal, and a sample and hold block that removes an overlap period between adjacently generated first holding clocks using the non-overlap signal to generate second holding clocks that do not overlap each other, applies sampled threshold voltages of the drive TFTs of the pixels to an output node in response to the second holding clocks, and discharges the output node in the overlap period in response to the non-overlap signal.

13 Claims, 10 Drawing Sheets

(P1) Vinit (DP (L)) (P2) Vth Sensing (DP (L)) (P3) NDI (DP (L)) +Programing (DP (R)) (P4) Emission (DP (R))

(P5) Vinit (DP (R)) (P6) Vth Sensing (DP (R)) (P7) NDI (DP (R)) +Programing (DP (L)) (P8) Emission (DP (L))

ORGANIC LIGHT EMITTING DIODE DISPLAY

This application claims the benefit of Korea Patent Application No. 10-2008-0098317 filed on Oct. 7, 2008, the entire contents of which is incorporated herein by reference for all purposes as if fully set forth herein.

BACKGROUND

1. Field of the Invention

Embodiments of the disclosure relate to an organic light emitting diode (OLED) display capable of improving display quality by accurately extracting a threshold voltage of a drive thin film transistor (TFT).

2. Discussion of the Related Art

Various flat panel displays whose weight and size are smaller than cathode ray tubes have been recently developed. Examples of the flat panel displays include a liquid crystal display (LCD), a field emission display (FED), a plasma display panel (PDP), and an electroluminescence device.

Because the PDP has a simple structure and is manufactured through a simple process, the PDP has been considered as a display device providing a large-sized screen while having characteristics such as lightness in weight and a thin profile. However, the PDP has disadvantages such as low light emitting efficiency, low luminance, and high power consumption. A thin film transistor (TFT) LCD using a TFT as a switching element is the most widely used flat panel display. However, because the TFT LCD is not a self-emission display, the TFT LCD has a narrow viewing angle and a low response speed. The electroluminescence device is classified into an inorganic light emitting diode display and an organic light emitting diode (OLED) display depending on a material of an emitting layer. Because the OLED display is a self-emission display, the OLED display has characteristics such as a fast response speed, a high light emitting efficiency, a high luminance, and a wide viewing angle.

The OLED display, as shown in FIG. 1, includes an organic light emitting diode. The organic light emitting diode includes organic compound layers between an anode electrode and a cathode electrode. The organic compound layers include a hole injection layer HIL, a hole transport layer HTL, an emitting layer EML, an electron transport layer ETL, and an electron injection layer EIL.

When a driving voltage is applied to the anode electrode and the cathode electrode, holes passing through the hole transport layer HTL and electrons passing through the electron transport layer ETL move to the emitting layer EML and form an exciton. Hence, the emitting layer EML generates visible light.

In the OLED display, pixels each including the above-described organic light emitting diode are arranged in a matrix format, and a brightness of the pixels selected by scan pulses is controlled by a gray level of video data. In the OLED display, the pixels are selected by selectively turning on a TFT used as an active element and remain in a light emitting state due to a charging voltage of a storage capacitor.

FIG. 2 is an equivalent circuit diagram of a pixel in a related art OLED display.

As shown in FIG. 2, each of pixels of a related art active matrix type OLED display includes an organic light emitting diode OLED, a data line DL, a gate line GL crossing the data line DL, a switch TFT SW, a drive TFT DR, and a storage capacitor Cst. Each of the switch TFT SW and the drive TFT DR may be implemented as an N-type metal-oxide semiconductor field effect transistor (MOSFET).

As the switch TFT SW is turned on in response to a scan pulse received from the gate line GL, a current path between a source electrode and a drain electrode of the switch TFT SW is switched on. During on-time of the switch TFT SW, a data voltage received from the data line DL is applied to a gate electrode of the drive TFT DR and the storage capacitor Cst.

The drive TFT DR controls a current flowing in the organic light emitting diode OLED depending on a voltage difference between the gate electrode and a source electrode of the drive TFT DR.

The storage capacitor Cst stores the data voltage applied to an electrode at one side of the storage capacitor Cst and thus keeps the data voltage applied to the gate electrode of the drive TFT DR constant during 1 frame period.

The organic light emitting diode OLED has a structure shown in FIG. 1. The organic light emitting diode OLED is connected between the source electrode of the drive TFT DR and a high potential driving voltage source VDD.

A brightness of the pixel shown in FIG. 2 is proportional to the current flowing in the organic light emitting diode OLED as indicated in the following Equation 1. The current flowing in the organic light emitting diode OLED is determined by a voltage difference between a gate voltage and a source voltage of the drive TFT DR and a threshold voltage of the drive TFT DR.

$$Ioled = \frac{k}{2}(Vgs - Vth)^2 \quad \text{[Equation 1]}$$

In the above Equation 1, loled indicates a driving current of the organic light emitting diode OLED, k a constant determined by a mobility and a parasitic capacitance of the drive TFT DR, Vgs a voltage difference between a gate voltage Vg and a source voltage Vs of the drive TFT DR, and Vth a threshold voltage of the drive TFT DR.

As indicated in the above Equation 1, the driving current loled of the organic light emitting diode OLED is greatly affected by the threshold voltage Vth of the drive TFT DR.

In the OLED display, non-uniformity of luminances of the pixels is generally caused by a difference between electrical properties of the drive TFTs including the threshold voltage. The difference between the electrical properties of the drive TFTs is caused by a backplane of a display panel. In a display panel using a low temperature polysilicon (LTPS) backplane, a difference between the electrical properties of the drive TFTs is caused by an excimer laser annealing (ELA) process. On the other hand, in a display panel using an amorphous silicon (a-Si) backplane, a difference between the electrical properties of the drive TFTs is caused by not a process but a difference between degradation levels of the drive TFTs. The difference between the degradation levels is caused because of a difference between gate-bias stresses of the gate electrodes of the drive TFTs, and the difference between gate-bias stresses causes the difference the threshold voltages of the drive TFTs.

When the same data is applied to the pixels, there is a difference between currents flowing in the organic light emitting diodes of the pixels because of the difference between the electrical properties of the drive TFTs. Accordingly, a method including extracting the threshold voltages of the drive TFTs, storing the extracted threshold voltages in a memory, and reflecting the stored threshold voltages in display data has been proposed. In the related art method, as shown in FIG. 3, a sample and hold block 1, an analog-to-digital converter (ADC) 2, and a memory 3 are used to extract the threshold voltages of the drive TFTs. Threshold voltages Vth1 to Vthk of the pixels on the same horizontal are simultaneously sampled in response to a sampling clock SC and then are sequentially extracted in response to holding clocks HC1 to HCk. The extracted threshold voltages Vth1 to Vthk are input to the ADC 2 via a common output node cno of the sample and hold block 1 and are converted into digital values D1~Dk. Then, the digital values D1~Dk are stored in the memory 3. The sample and hold block 1 includes a plurality of sampling switches simultaneously operating in response to the sampling clock SC and a plurality of holding switches individually operating in response to the holding clocks HC1 to HCk.

As shown in FIG. 4, at a time when logic levels of the holding clocks HC1 to HCk change, the logic levels of the holding clocks HC1 to HCk do not critically change as indicated by 'a' but gradually changes as indicated by 'b' because of an influence such as a parasitic capacitance existing in a switch and a line. Hence, in the related art method for extracting the threshold voltage, when the holding switches are switched on or off, the threshold voltages of the adjacent pixels are extracted in a state where the threshold voltages of the adjacent pixels partially overlap each other. Namely, an overlap period OVP of the threshold voltages is generated. Because the threshold voltages of the adjacent pixels are mixed in the overlap period OVP, it is almost impossible to accurately extract the threshold voltages.

Further, interference occurs between successively output threshold voltages at the common output node cno of the sample and hold block 1 because of the parasitic capacitance existing in the switch and the line. Because a charge component of a previously output threshold voltage remains in the switch or the line and acts as the parasitic capacitance, the previously output threshold voltage affects a currently output threshold voltage. Because the related art method for extracting the threshold voltage does not perform an operation capable of discharging the remaining charge components, it is almost impossible to accurately extract the threshold voltages.

Accordingly, there is a limit to an improvement in a display quality in the related art method for extracting the threshold voltage.

BRIEF SUMMARY

In one aspect, an organic light emitting diode (OLED) display comprises a display panel including a plurality of pairs of data lines, a plurality of gate line groups crossing the plurality of pairs of data lines, and a plurality of pixels each having two drive thin film transistors and an organic light emitting diode; a timing controller generating a non-overlap signal; and a sample and hold block that removes an overlap period between adjacently generated first holding clocks using the non-overlap signal to generate second holding clocks that do not overlap each other, applies sampled threshold voltages of the drive thin film transistors of the pixels to an output node in response to the second holding clocks, and discharges the output node in the overlap period in response to the non-overlap signal.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE DRAWINGS AND THE PRESENTLY PREFERRED EMBODIMENTS

Reference will now be made in detail to embodiments of the invention, examples of which are illustrated in the accompanying drawings.

Figure 1:
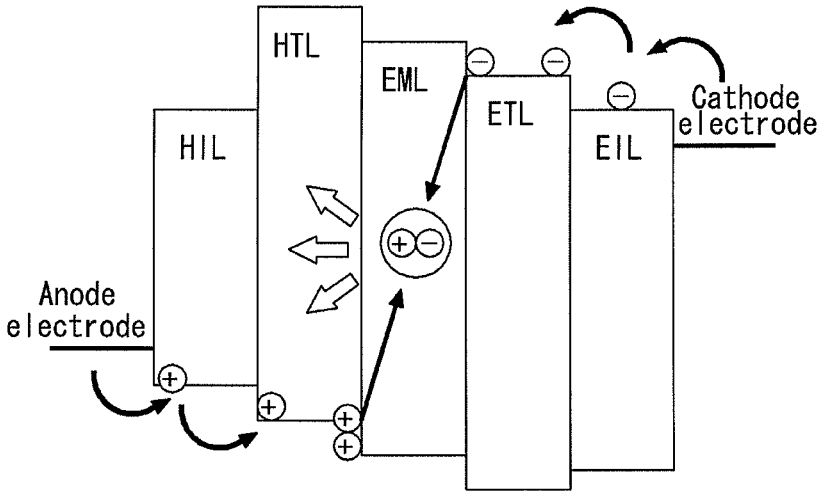
FIG. 1 (RELATED ART)
FIG. 1 is a diagram for explaining a light emitting principle of a general organic light emitting diode (OLED) display.
Figure 2:
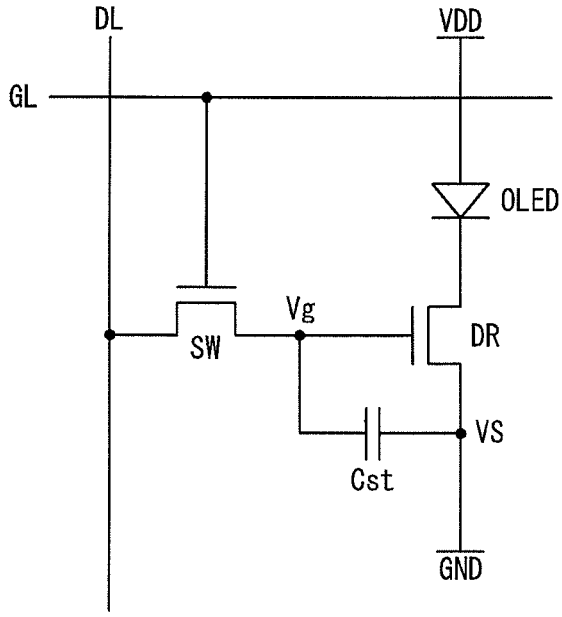
FIG. 2 (RELATED ART)
FIG. 2 is an equivalent circuit diagram of a pixel in a related art OLED display.
Figure 3:
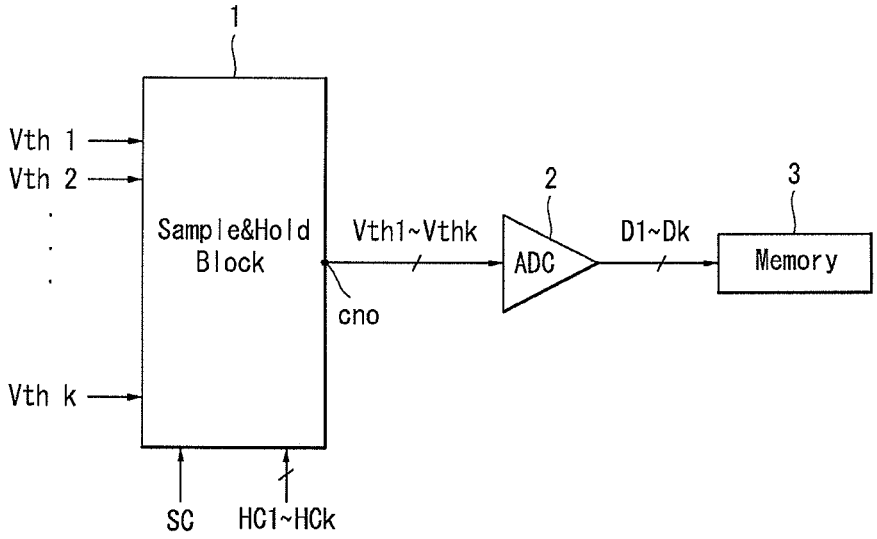
FIG. 3 (RELATED ART)
FIG. 3 is a block diagram illustrating a method for extracting a threshold voltage of a related art drive thin film transistor (TFT)
Figure 4:
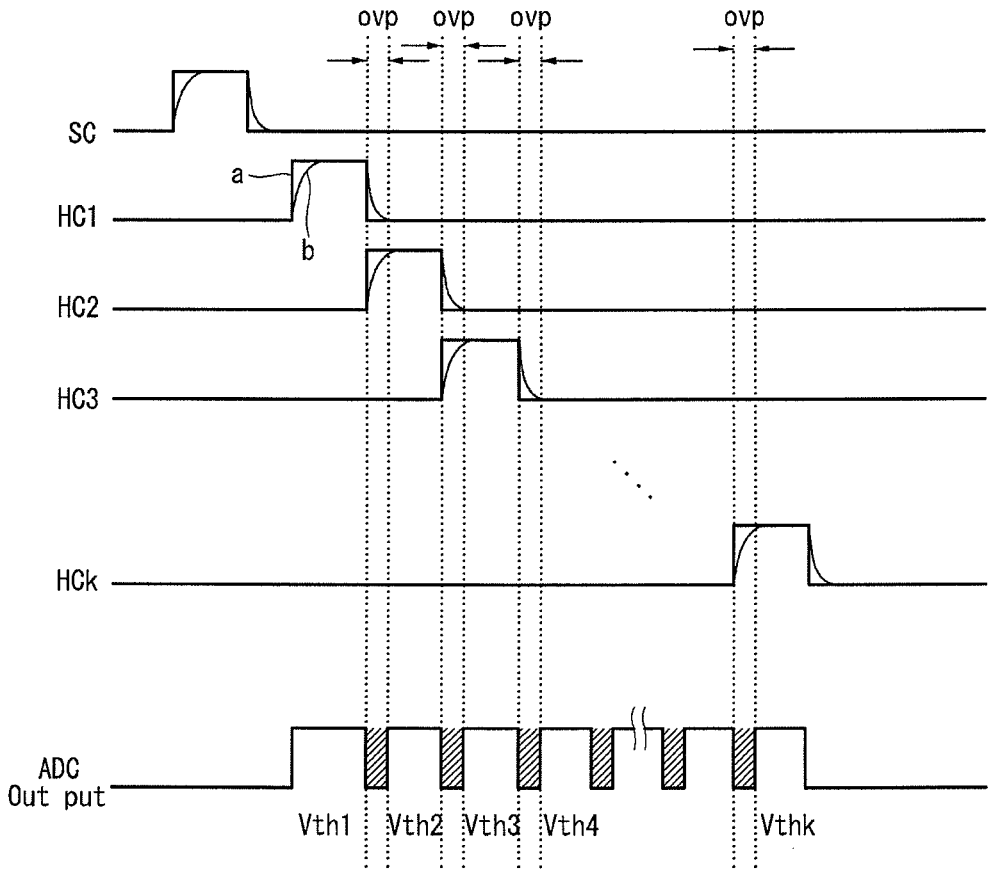
FIG. 4 (RELATED ART)
FIG. 4 is a diagram illustrating a waveform of control signals used to extract a threshold voltage of a related art drive TFT and an output of an analog-to-digital converter (ADC) depending on the waveform.
Figure 5:
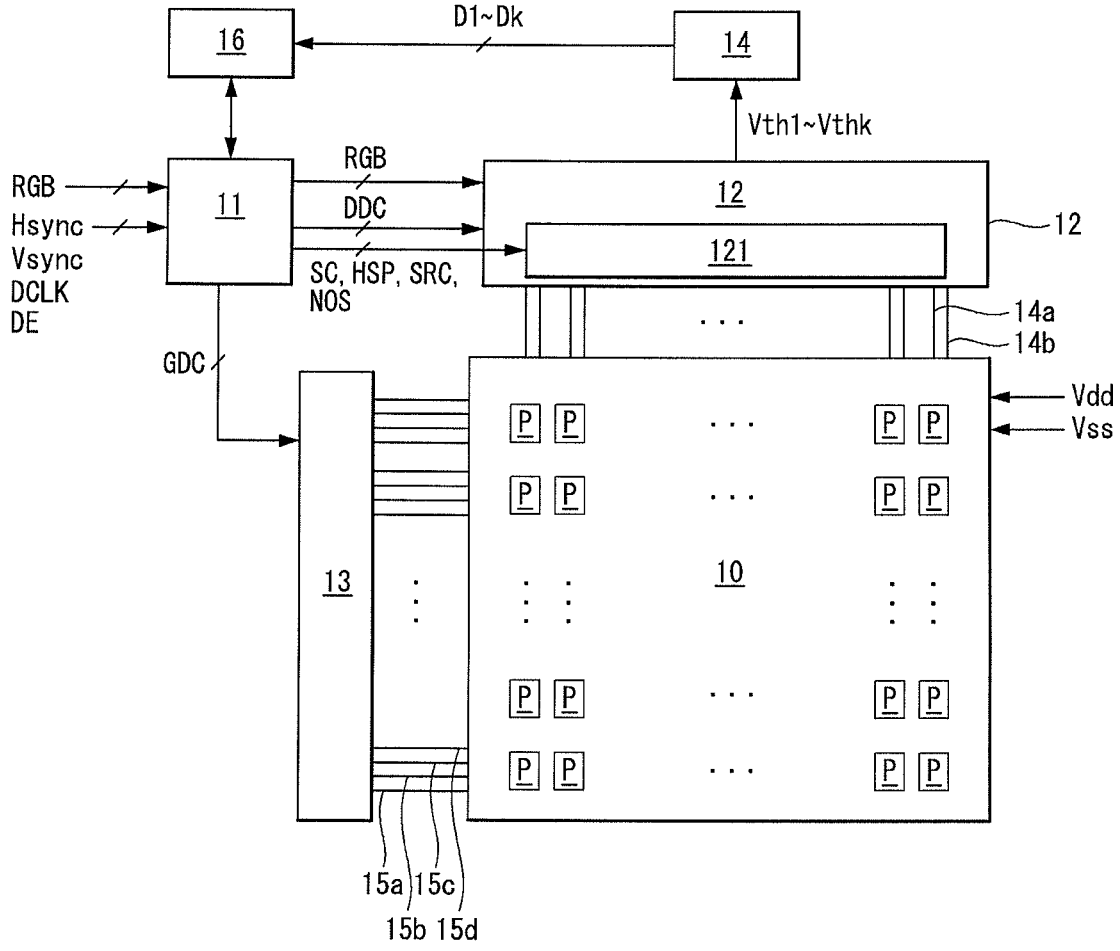
FIG. 5 is a block diagram illustrating an OLED display according to an embodiment.

FIG. 5 is a block diagram illustrating an organic light emitting diode (OLED) display according to an embodiment of the disclosure.

As shown in FIG. 5, an OLED display according to an embodiment of the disclosure includes a display panel 10, a timing controller 11, a data driver 12 including a sample and hold block 121, a gate driver 13, an analog-to-digital converter (ADC) 14, and a memory 16.

The display panel 10 includes a plurality of pairs of data lines 14*a* and 14*b*, a plurality of gate line groups 15*a* to 15*d* crossing the plurality of pairs of data lines 14*a* and 14*b*, and a pixel P arranged at each of crossings of the plurality of pairs of data lines 14*a* and 14*b* and the plurality of gate line groups 15*a* to 15*d* in a matrix format. Each of the pixels P receives a high potential driving voltage Vdd and a low potential driving voltage Vss and is connected to the pairs of data lines 14*a* and 14*b* and the gate line groups 15*a* to 15*d*. Each of the pairs of data lines includes a first data line 14*a* and a second data line 14*b*. The first and second data lines 14*a* and 14*b* are used in an extraction path of a threshold voltage of a drive thin film transistor (TFT) and a write path of display data, respectively. Functions of the first and second data lines 14*a* and 14*b* are reversed to each other every predetermined period of time. More specifically, the first data line 14*a* is used in the extraction path of the threshold voltage of the drive TFT during first to n-th frame periods (where n is a vertical resolution) and is used in the write path of the display data during (n+1)-th to 2n-th frame periods. On the other hand, the second data line 14*b* is used in the write path of the display data during the first to n-th frame periods and is used in the extraction path of the threshold voltage of the drive TFT during the (n+1)-th to 2n-th frame periods. The gate line groups 15*a* to 15*d* include a first scan line 15*a*, a second scan line 15*b*, a first sensing line 15*c*, and a second sensing line 15*d*. The high potential driving voltage Vdd is generated by a high potential driving voltage source VDD and has a uniform potential level (i.e., DC level). The low potential driving voltage Vss is generated by a low potential driving voltage source VSS, and a potential level of the low potential driving voltage Vss periodically varies between the high potential driving voltage Vdd and a ground level voltage so as to sense the threshold voltage of the drive TFT.

The timing controller 11 controls a gray level of display data RGB received from the outside based on information stored in the memory 16, such as digital threshold voltages D1 to Dk and location information about each of the digital threshold voltages D1 to Dk, and then rearrange the controlled display data RGB in conformity with a resolution of the display panel 10 to supply the rearranged display data RGB to the data driver 12. The timing controller 11 controls the gray level of the display data RGB using a threshold voltage corresponding to location information of the display data RGB received from the outside. In this case, as the threshold voltage increases, the gray level of the display data RGB is controlled to an increase.

The timing controller 11 generates a data write control signal DDC for controlling data write timing in the data driver 12, a threshold voltage extraction control signal for controlling threshold voltage extraction timing in the data driver 12, and a gate control signal GDC for controlling operation timing of the gate driver 13 based on timing signals, such as horizontal and vertical sync signals Hsync and Vsync, a data enable signal DE, a dot clock DCLK. The data write control signal DDC includes a source sampling clock SSC indicating a latch operation of display data inside the data driver 12 based on a rising or falling edge, a source output enable signal SOE indicating an output of the data driver 12, and the like. The threshold voltage extraction control signal includes a sampling clock SC for sampling a threshold voltage, a holding start pulse HSP indicating a holding start time point of a threshold voltage, a shift register clock SRC for sequentially shifting the holding start pulse HSP, and a non-overlap signal NOS for preventing threshold voltages of drive TFTs of horizontally adjacent pixels from overlapping each other and from being extracted in an overlap state. The gate control signal GDC includes a gate start pulse GSP, a gate shift clock GSC, a gate output enable signal GOE, and the like. The gate start pulse GSP indicates a scan start horizontal line in 1 frame period during which one screen is displayed. The gate shift clock GSC is input to a shift resistor of the gate driver 13 to sequentially shift the gate start pulse GSP and has a pulse width corresponding to a turned-on period of a TFT. The gate output enable signal GOE indicates an output of the gate driver 13.

Figure 8:
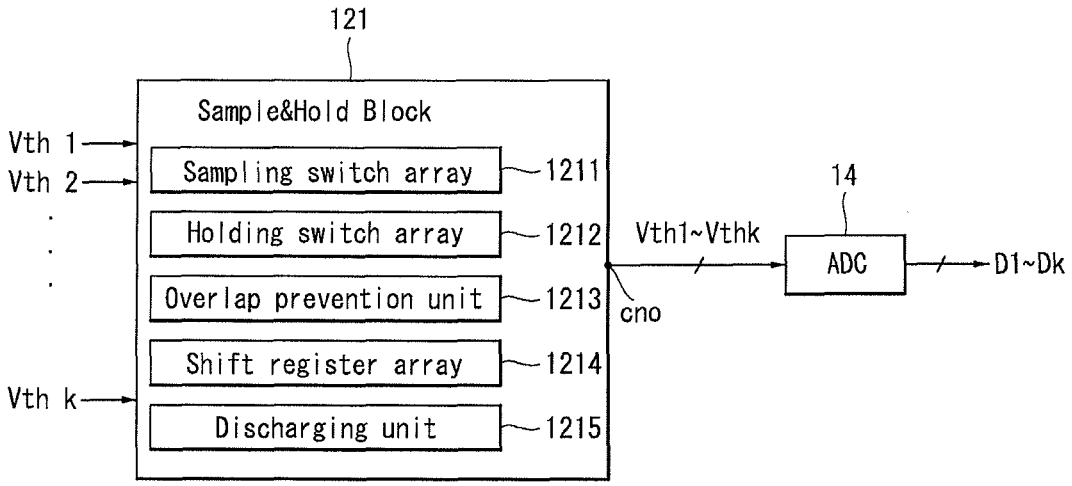
FIG. 8 is a block diagram illustrating a sample and hold block.

The data driver 12 converts the display data RGB into an analog data voltage (hereinafter referred to as a data voltage) under the control of the timing controller 11 to supply the data voltage to the pairs of data lines 14*a* and 4*b*. The data driver 12 including the sample and hold block 121 supplies analog threshold voltages Vth1 to Vthk extracted from the pixels P to the ADC 14. The sample and hold block 121, as shown in FIG. 8, includes an overlap prevention unit 1213, that prevents threshold voltages of drive TFTs of horizontally adjacent pixels from overlapping each other and from being extracted in an overlap state, and a discharging unit 1215 preventing an interference of the threshold voltages successively output through a common output node cno. The sample and hold block 121 will be later described in detail with reference to FIGS. 8 to 10.

Figure 6:
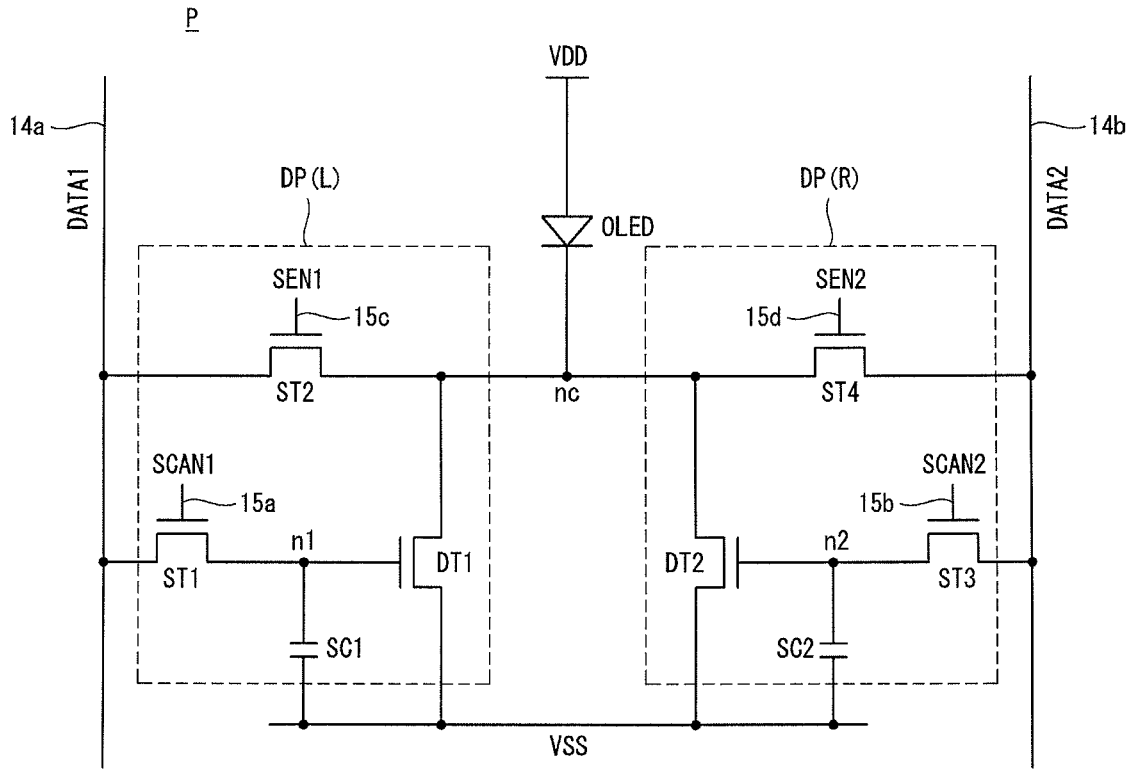
FIG. 6 is an equivalent circuit diagram of a pixel.

The gate driver 13 generates first and second scan signals SCAN1 and SCAN2 and first and second sensing signals SEN1 and SEN2 under the control of the timing controller 11. As shown in FIG. 6, the first scan signal SCAN1 is supplied to the first scan line 15*a*, and the second scan signal SCAN2 is supplied to the second scan line 15*b*. The first sensing signal SEN1 is supplied to the first sensing line 15*c*, and the second sensing signal SEN2 is supplied to the second sensing line 15*d*.

The ADC 14 converts the analog threshold voltages Vth1 to Vthk received from the sample and hold block 121 into the digital threshold voltages D1 to Dk and then supplies the digital threshold voltages D1 to Dk to the memory 16.

The memory 16 stores the digital threshold voltages D1 to Dk from the ADC 14 and location information about each of the digital threshold voltages D1 to Dk in the form of a lookup table. The memory 16 may be mounted inside the timing controller 11.

Figure 7:
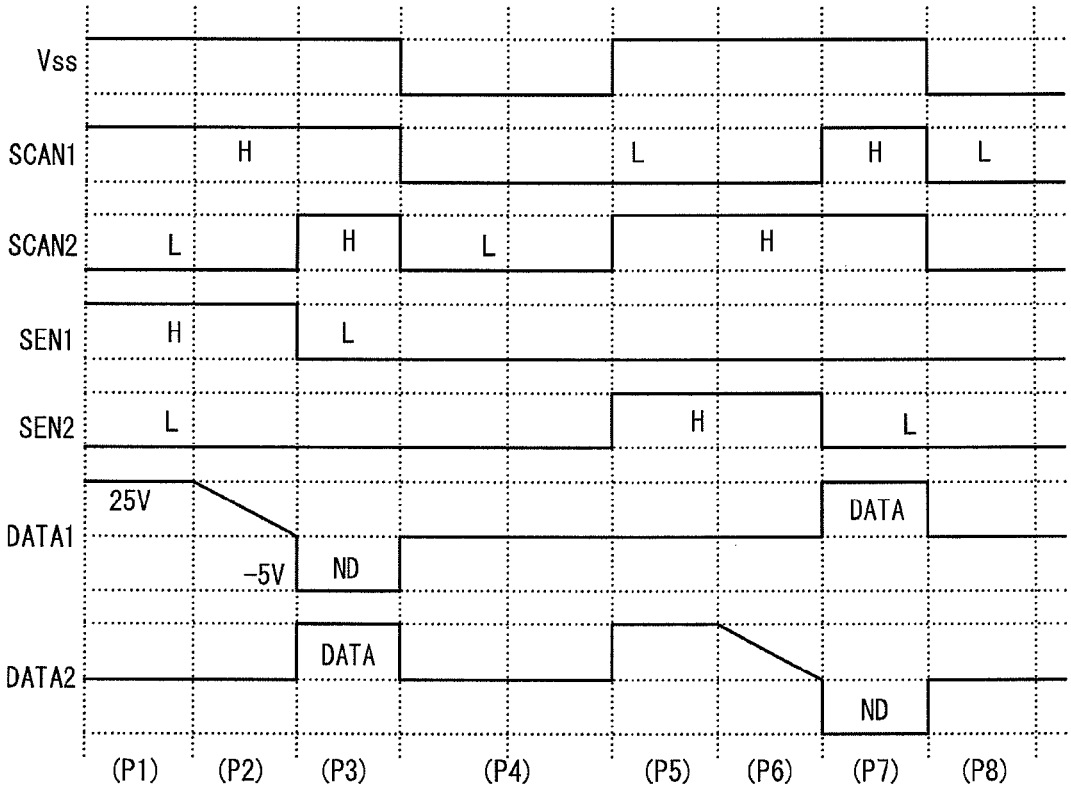
FIG. 7 is a timing diagram of control signals, data voltages, and driving voltages applied to a pixel.

FIG. 6 is an equivalent circuit diagram of the pixel P of FIG. 5. FIG. 7 is a timing diagram of control signals, data voltages, and driving voltages applied to the pixel P.

As shown in FIG. 6, the pixel P includes an organic light emitting diode OLED, a first driver DP(L), and a second driver DP(R).

The organic light emitting diode OLED is connected between the high potential driving voltage source VDD and a common node nc. An amount of light emitted by the organic light emitting diode OLED is controlled by an amount of current flowing between the high potential driving voltage source VDD and the low potential driving voltage source VSS determined by the first driver DP(L) or the second driver DP(R). Thus the organic light emitting diode OLED represents a gray scale depending on the current amount.

The first driver DP(L) includes a first drive TFT DT1, first and second switch TFTs ST1 and ST2, and a first storage capacitor SC1. The first drive TFT DT1 is connected between the common node nc and the low potential driving voltage source VSS and controls an amount of current flowing in the organic light emitting diode OLED using a voltage difference between a gate electrode and a source electrode of the first drive TFT DT1. The first switch TFT ST1 is connected between the first data line 14*a* and a first node n1 and switches on a current path between the first data line 14*a* and the first node n1 in response to the first scan signal SCAN1 from the first scan line 15*a*. The second switch TFT ST2 is connected between the first data line 14*a* and the common node nc and switches on a current path between the first data line 14*a* and the common node nc in response to the first sensing signal SEN1 from the first sensing line 15*c*. The first storage capacitor SC1 is connected between the first node n1 and the low potential driving voltage source VSS.

The first driver DP(L) alternately performs a threshold voltage sensing operation and a display data write operation every a predetermined period of time (for example, every a total of scan periods of n frame periods, where n is a vertical resolution). More specifically, for the threshold voltage sensing operation, the first driver DP(L) performs a threshold voltage sensing operation of the first drive TFT DT1 during one frame period of first to n-th frame periods (where n is a vertical resolution) and performs a negative data write operation during the other frame periods so as to reduce a gate-bias stress of the first drive TFT DT1. For the display data write operation, the first driver DP(L) performs the display data write operation for allowing the organic light emitting diode OLED to emit light during (n+1)-th to 2n-th frame periods.

The second driver DP(R) includes a second drive TFT DT2, third and fourth switch TFTs ST3 and ST4, and a second storage capacitor SC2. The second drive TFT DT2 is connected between the common node nc and the low potential driving voltage source VSS and controls an amount of current flowing in the organic light emitting diode OLED using a voltage difference between a gate electrode and a source electrode of the second drive TFT DT2. The third switch TFT ST3 is connected between the second data line 14*b* and a second node n2 and switches on a current path between the second data line 14*b* and the second node n2 in response to the second scan signal SCAN2 from the second scan line 15*b*. The fourth switch TFT ST4 is connected between the second data line 14*b* and the common node nc and switches on a current path between the second data line 14*b* and the common node nc in response to the second sensing signal SEN2 from the second sensing line 15*d*. The second storage capacitor SC2 is connected between the second node n2 and the low potential driving voltage source VSS.

The second driver DP(R) alternately performs a threshold voltage sensing operation and a display data write operation every a predetermined period of time (for example, every a total of scan periods of n frame periods, where n is a vertical resolution). The operation of the second driver DP(R) is reversed to the operation of the first driver DP(L) during the same frame periods. More specifically, during the first to n-th frame periods during which the first driver DP(L) performs the threshold voltage sensing operation, the second driver DP(R) performs a display data write operation for allowing the organic light emitting diode OLED to emit light. During the (n+1)-th to 2n-th frame periods during which the first driver DP(L) performs the display data write operation, the second driver DP(R) performs a threshold voltage sensing operation of the second drive TFT DT2 during one frame period of the (n+1)-th to 2n-th frame periods and performs a negative data write operation during the other frame periods so as to reduce a gate-bias stress of the second drive TFT DT2.

An operation of the pixel P shown in FIG. 6 is described below with reference to the timing diagram of FIG. 7. In FIG. 7, P1 to P4 indicate periods obtained by dividing one frame period of first to n-th frame periods (where n is a vertical resolution). More specifically, P1 indicates a period for initializing a voltage at each node of the first driver DP(L), P2 indicates a period for sensing the threshold voltage of the first drive TFT DT1, P3 indicates a period for writing negative data ND to the first driver DP(L) and programming the second driver DP(R) using display data DATA, and P4 indicates a period for allowing the organic light emitting diode OLED to emit light using the second driver DP(R). P5 to P8 indicate periods obtained by dividing one frame period of (n+1)-th to 2n-th frame periods. More specifically, P5 indicates a period for initializing a voltage at each node of the second driver DP(R), P6 indicates a period for sensing the threshold voltage of the second drive TFT DT2, P7 indicates a period for writing negative data ND to the second driver DP(R) and programming the first driver DP(L) using display data DATA, and P8 indicates a period for allowing the organic light emitting diode OLED to emit light using the first driver DP(L).

During the period P1, the low potential driving voltage Vss having the same level as the high potential driving voltage Vdd is generated by the low potential driving voltage source VSS, and a first data voltage DATA1 corresponding to a sum of the high potential driving voltage Vdd and a maximum threshold voltage of the first drive TFT DT1 is supplied to the first data line 14*a*. For example, supposing that the high potential driving voltage Vdd is 18V and the maximum threshold voltage of the first drive TFT DT1 is 7V, the first data voltage DATA1 of 25V is supplied to the first data line 14*a*. During the period P1, the first scan signal SCAN1 of a high logic level and the first sensing signal SEN1 of a high logic level are generated, and thus the first and second switch TFTs ST1 and ST2 are turned on. Hence, the first drive TFT DT1 is diode-connected by connection of the common node nc and the first node n1. During the period P1, the second scan signal SCAN2 of a low logic level and the second sensing signal SEN2 of a low logic level are generated, and thus the third and fourth switch TFTs ST3 and ST4 are turned off.

During the period P2, the data driver 12 allows the first data line 14*a* to be floated by operating an internal switch of the data driver 12. During the period P2, the first scan signal SCAN1 and the first sensing signal SEN1 remain at the high logic level, and thus the first and second switch TFTs ST1 and ST2 continuously remain in a turned-on state. A level of the low potential driving voltage Vss remains at a level of the high potential driving voltage Vdd. Hence, a voltage of the first node n1 falls from a voltage level corresponding to a sum of the high potential driving voltage Vdd and the maximum threshold voltage of the first drive TFT DT1 to a voltage level corresponding to a sum of the high potential driving voltage Vdd and an actual threshold voltage of the first drive TFT DT1. The maximum threshold voltage of the first drive TFT DT1 is greater than the actual threshold voltage of the first drive TFT DT1. A voltage difference between the first node n1 and the low potential driving voltage source VSS is the actual threshold voltage of the first drive TFT DT1, and the actual threshold voltage of the first drive TFT DT1 is stored in the first storage capacitor SC1. Subsequently, the data driver 12 connects the first data line 14*a* to the sample and hold block 121 by operating an internal switch of the data driver 12. Accordingly, the actual threshold voltage of the first drive TFT DT1 stored in the first storage capacitor SC1 is transferred to the sample and hold block 121 via the first data line 14*a*. During the period P2, the second scan signal SCAN2 and the second sensing signal SEN2 remain at the low logic level, and thus the third and fourth switch TFTs ST3 and ST4 continuously remain in a turned-off state.

During the period P3, the data driver 12 supplies the first data voltage DATA1 with the same level as the negative data ND to the first data line 14*a* and supplies a second data voltage DATA2 of a programming level to the second data line 14*b* by operating an internal switch of the data driver 12. A level of the low potential driving voltage Vss remains at a level of the high potential driving voltage Vdd. During the period P3, the first scan signal SCAN1 remains at the high logic level, and thus the first switch TFT ST1 continuously remains in a turned-on state. On the other hand, a level of the first sensing signal SEN1 is inverted to a low logic level, and thus the second switch TFT ST2 is turned off. Hence, the first data voltage DATA1 with the same level as the negative data ND is supplied to the first node n1. During the period P3, a level of the second scan signal SCAN2 is inverted to a high logic level, and thus the third switch TFT ST3 is turned on. On the other hand, the second sensing signal SEN2 remains at the low logic level, and thus the fourth switch TFT ST4 continuously remains in a turned-off state. Hence, the second node n2 is programmed to the second data voltage DATA2 corresponding to the display data DATA.

During the period P4, a level of the low potential driving voltage Vss is lowered to a ground level, and thus a current path is formed between the high potential driving voltage source VDD and the low potential driving voltage source VSS. During the period P4, a level of the first and second scan signals SCAN1 and SCAN2 are inverted to a low logic level, and thus the first and third switch TFTs ST1 and ST3 are turned off. On the other hand, the first and second sensing signals SEN1 and SEN2 remain at the low logic level, and thus the second and fourth switch TFTs ST2 and ST4 continuously remain in a turned-off state. Hence, a voltage of the first node n1 falls from the level of the negative data ND by a change amount of the low potential driving voltage Vss, and thus a gate-bias stress of the first drive TFT DT1 is reduced. A voltage of the second node n2 falls from the level of the display data DATA by a change amount of the low potential driving voltage Vss. A voltage difference between the second node n2 and the low potential driving voltage source VSS is stored in the second storage capacitor SC2, and an amount of current flowing in the organic light emitting diode OLED is determined by the stored voltage difference. The organic light emitting diode OLED emits light depending on the determined current amount to represent a gray scale.

During the period P5, the low potential driving voltage Vss having the same level as the high potential driving voltage Vdd is generated by the low potential driving voltage source VSS, and a second data voltage DATA2 corresponding to a sum of the high potential driving voltage Vdd and a maximum threshold voltage of the second drive TFT DT2 is supplied to the second data line 14*b*. For example, supposing that the high potential driving voltage Vdd is 18V and the maximum threshold voltage of the second drive TFT DT2 is 7V, the second data voltage DATA2 of 25V is supplied to the second data line 14*b*. During the period P5, the second scan signal SCAN2 of a high logic level and the second sensing signal SEN2 of a high logic level are generated, and thus the third and fourth switch TFTs ST3 and ST4 are turned on. Hence, the second drive TFT DT2 is diode-connected by connection of the common node nc and the second node n2. During the period P5, the first scan signal SCAN1 of a low logic level and the first sensing signal SEN1 of a low logic level are generated, and thus the first and second switch TFTs ST1 and ST2 are turned off.

During the period P6, the data driver 12 allows the second data line 14*b* to be floated by operating an internal switch of the data driver 12. During the period P6, the second scan signal SCAN2 and the second sensing signal SEN2 remain at the high logic level, and thus the third and fourth switch TFTs ST3 and ST4 continuously remain in a turned-on state. A level of the low potential driving voltage Vss remains at a level of the high potential driving voltage Vdd. Hence, a voltage of the second node n2 falls from a voltage level corresponding to a sum of the high potential driving voltage Vdd and the maximum threshold voltage of the second drive TFT DT2 to a voltage level corresponding to a sum of the high potential driving voltage Vdd and an actual threshold voltage of the second drive TFT DT2. The maximum threshold voltage of the second drive TFT DT2 is greater than the actual threshold voltage of the second drive TFT DT2. A voltage difference between the second node n2 and the low potential driving voltage source VSS is the actual threshold voltage of the second drive TFT DT2, and the actual threshold voltage of the second drive TFT DT2 is stored in the second storage capacitor SC2. Subsequently, the data driver 12 connects the second data line 14*b* to the sample and hold block 121 by operating an internal switch of the data driver 12. Accordingly, the actual threshold voltage of the second drive TFT DT2 stored in the second storage capacitor SC2 is transferred to the sample and hold block 121 via the second data line 14*b*. During the period P6, the first scan signal SCAN1 and the first sensing signal SEN1 remain at the low logic level, and thus the first and second switch TFTs ST1 and ST2 continuously remain in a turned-off state.

During the period P7, the data driver 12 supplies the second data voltage DATA2 with the same level as the negative data ND to the second data line 14*b* and supplies the first data voltage DATA1 of a programming level to the first data line 14*a* by operating an internal switch of the data driver 12. A level of the low potential driving voltage Vss remains at a level of the high potential driving voltage Vdd. During the period P7, the second scan signal SCAN2 remains at the high logic level, and thus the third switch TFT ST3 continuously remains in a turned-on state. On the other hand, a level of the second sensing signal SEN2 is inverted to a low logic level, and thus the fourth switch TFT ST4 is turned off. Hence, the second data voltage DATA2 with the same level as the negative data ND is supplied to the second node n2. During the period P7, a level of the first scan signal SCAN1 is inverted to a high logic level, and thus the first switch TFT ST1 is turned on. On the other hand, the first sensing signal SEN1 remains at the low logic level, and thus the second switch TFT ST2 continuously remains in a turned-off state. Hence, the first node n1 is programmed to the first data voltage DATA1 corresponding to the display data DATA.

During the period P8, a level of the low potential driving voltage Vss is lowered to a ground level, and thus a current path is formed between the high potential driving voltage source VDD and the low potential driving voltage source VSS. During the period P8, a level of the first and second scan signals SCAN1 and SCAN2 are inverted to a low logic level, and thus the first and third switch TFTs ST1 and ST3 are turned off. On the other hand, the first and second sensing signals SEN1 and SEN2 remain at the low logic level, and thus the second and fourth switch TFTs ST2 and ST4 continuously remain in a turned-off state. Hence, a voltage of the second node n2 falls from the level of the negative data ND by a change amount of the low potential driving voltage Vss, and thus a gate-bias stress of the second drive TFT DT2 is reduced. A voltage of the first node n1 falls from the level of the display data DATA by a change amount of the low potential driving voltage Vss. A voltage difference between the first node n1 and the low potential driving voltage source VSS is stored in the first storage capacitor SC1, and an amount of a current flowing in the organic light emitting diode OLED is determined by the stored voltage difference. The organic light emitting diode OLED emits light depending on the determined current amount to represent a gray scale.

Figure 9:
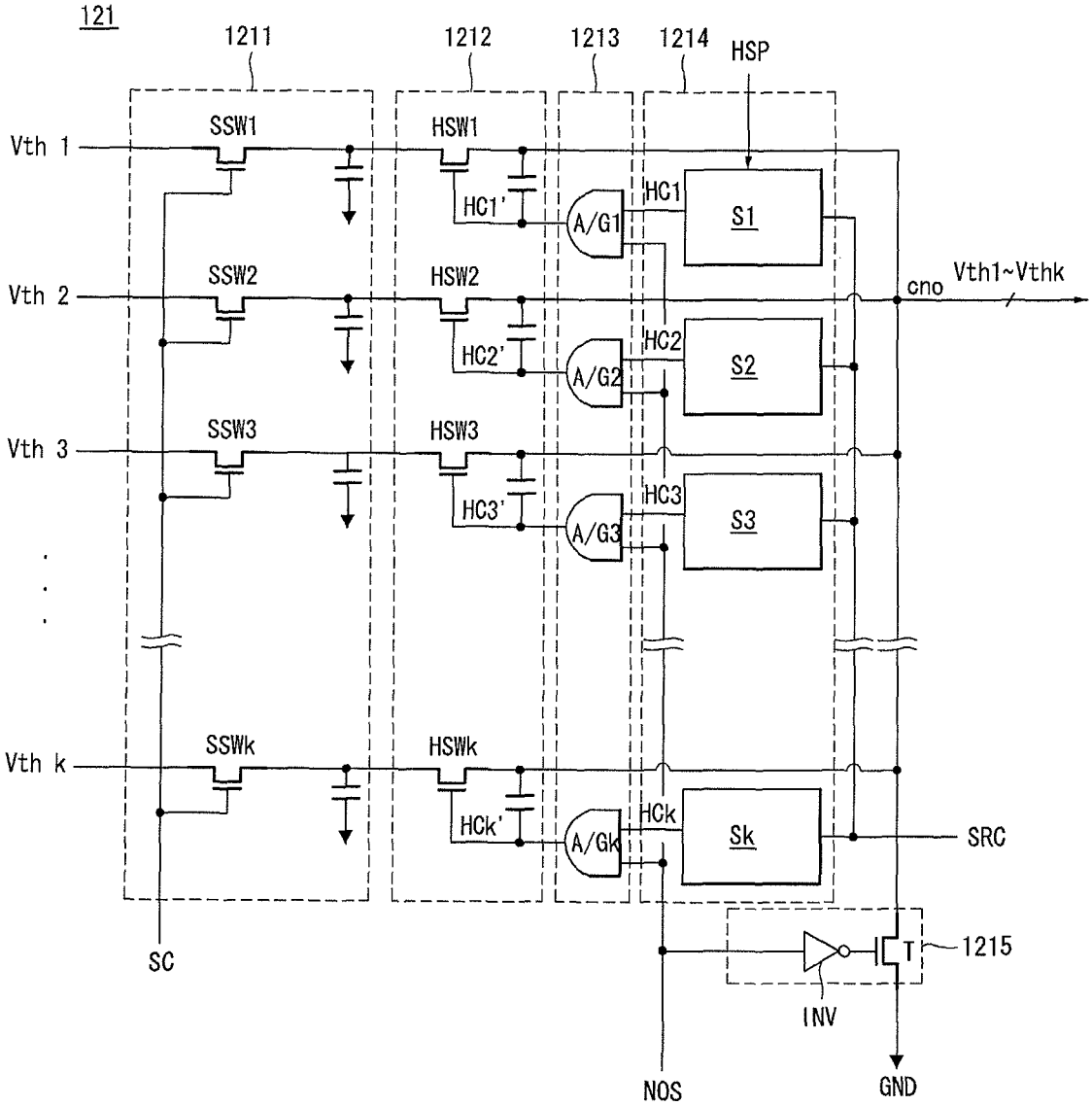
FIG. 9 is a circuit diagram illustrating the sample and hold block.
Figure 10:
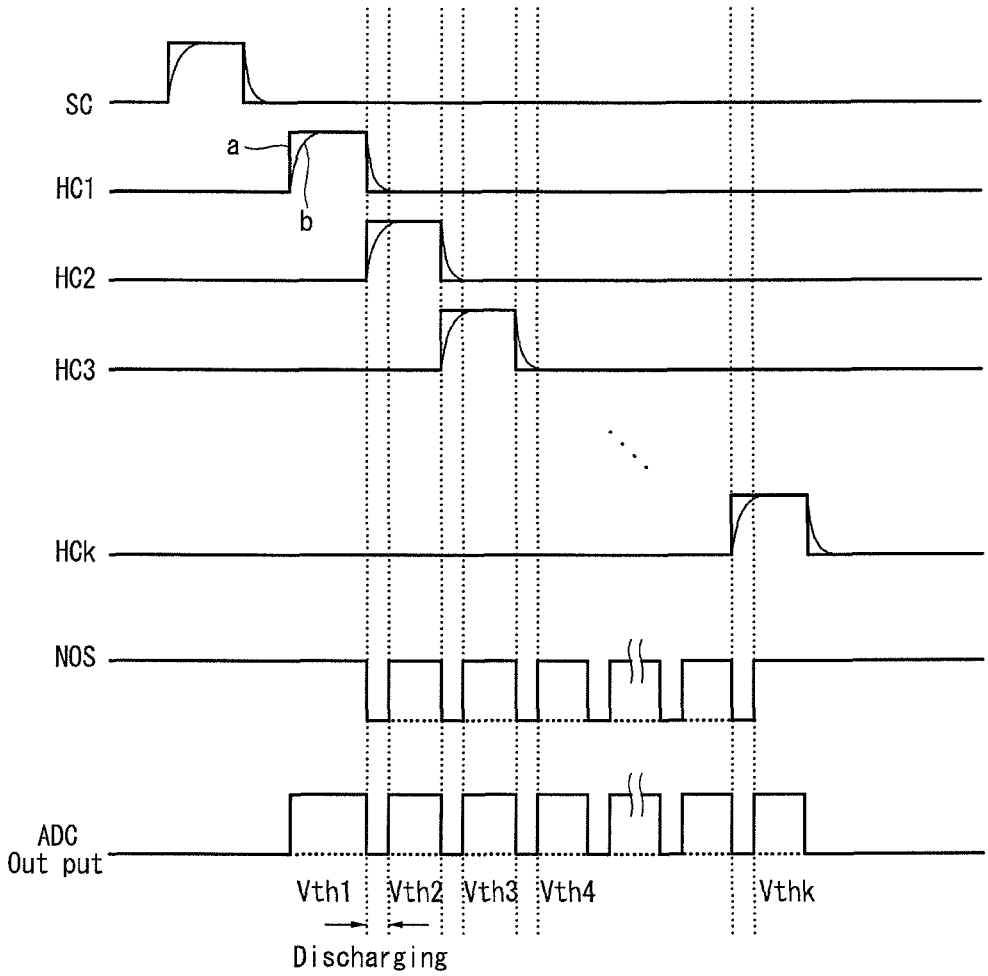
FIG. 10 is a diagram illustrating a waveform of control signals used to extract a threshold voltage of a drive TFT and an output of an analog-to-digital converter (ADC) depending on the waveform.

FIGS. 8 and 9 are a block diagram and a circuit diagram illustrating the sample and hold block 121, respectively. FIG. 10 is a diagram illustrating a waveform of control signals used to extract the threshold voltage of the drive TFT and an output of the ADC depending on the waveform.

As shown in FIGS. 8 and 9, the sample and hold block 121 includes a sampling switch array 1211, a holding switch array 1212, an overlap prevention unit 1213, a shift register array 1214, and a discharging unit 1215.

The sampling switch array 1211 includes a plurality of sampling switches SSW1 to SSWk that are switched on in response to the sampling clock SC from the timing controller 11. The sampling switch array 1211 simultaneously samples the threshold voltages Vth1 to Vthk of the first drive TFTs on 1 horizontal line during 1 frame period through the switched-on sampling switches SSW1 to SSWk. Namely, the sampling switch array 1211 performs a sampling operation on 1 horizontal line per 1 frame period. Accordingly, n frame periods (where n is a vertical resolution) are required to sample all the threshold voltages of the first drive TFTs of the display panel 10. The sampling switch array 1211 sequentially performs a sampling operation during the n frame periods. The sampling switch array 1211 simultaneously samples the threshold voltages Vth1 to Vthk of the second drive TFTs on 1 horizontal line during 1 frame period through the switched-on sampling switches SSW1 to SSWk. The sampling switch array 1211 sequentially performs a sampling operation during n frame periods following the n frame periods. To sample the threshold voltages Vth1 to Vthk of each of the first and second drive TFTs, the plurality of sampling switches SSW1 to SSWk are alternately connected to the k first data lines 14*a* and the k second data lines 14*b* each for n frame periods.

The holding switch array 1212 includes a plurality of holding switches HSW1 to HSWk that are switched on in response to each of second holding clocks HC1' to HCk'. The holding switch array 1212 sequentially outputs the sampled threshold voltages Vth1 to Vthk to the common output node cno using the switched-on holding switches HSW1 to HSWk.

The shift register array 1214 includes a plurality of cascade-connected stages S1 to Sk. The shift register array 1214 sequentially shifts the holding start pulse HSP from the first stage S1 to the k-th stage Sk in response to the shift register clock SRC from the timing controller 11 to generate first holding clocks HC1 to HCk. As shown in FIG. 10, at a time when logic levels of the first holding clocks HC1 to HCk change, the logic levels of the first holding clocks HC1 to HCk do not critically change as indicated by 'a' but gradually changes as indicated by 'b' because of an influence such as a parasitic capacitance existing in the switch and the line. Therefore, the first holding clocks HC1 to HCk partially overlap each other.

The overlap prevention unit 1213 includes a plurality of AND elements A/G1 to A/Gk respectively connected to output terminals of the plurality of stages S1 to Sk. The overlap prevention unit 1213 performs an AND operation on the non-overlap signal NOS from the timing controller 11 and the first holding clocks HC1 to HCk to generate the second holding clocks HC1' to HCk' that do not overlap one another. While the non-overlap signal NOS of a low logic level opposite a level of the first holding clocks is generated in an overlap period of the adjacent first holding clocks, the non-overlap signal NOS of the same high logic level as the first holding clocks is generated in a non-overlap period of the adjacent first holding clocks. Hence, because the holding switches HSW1 to HSWk operate in response to the second holding clocks HC1' to HCk' that do not overlap one another, the threshold voltages Vth1 to Vthk, as shown in FIG. 10, can be accurately extracted without a partial overlap between the threshold voltages of the adjacent pixels.

The discharging unit 1215 includes a phase inversion unit INV for inverting a phase of the non-overlap signal NOS from the timing controller 11 and a discharge switch T that is connected between the common output node cno and a ground level voltage source GND and is controlled by an output signal of the phase inversion unit INV. The phase inversion unit INV may include an AND gate and an inverter or may include a NAND gate. The discharge switch T is turned on in the overlap period where the non-overlap signal NOS of the low logic level is generated and thus discharges charge components remaining in the common output node cno. Hence, an interference between the successively output threshold voltages is removed. As a result, the threshold voltages Vth1 to Vthk can be more accurately extracted.

As described above, because the OLED display according to the embodiment of the invention includes the overlap prevention unit and the discharging unit inside the sample and hold block, the threshold voltages can be accurately extracted without the interference between the successively output threshold voltages.

Furthermore, because the OLED display according to the embodiment of the invention accurately extracts the threshold voltages of the drive TFTs and reflects the extracted threshold voltages in the display data, the display quality can be greatly improved.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. An organic light emitting diode (OLED) display comprising:

a display panel including a plurality of pairs of data lines, a plurality of gate line groups crossing the plurality of pairs of data lines, and a plurality of pixels each having two drive thin film transistors and an organic light emitting diode;

a timing controller that generates a non-overlap signal; and a sample and hold block that removes an overlap period between adjacently generated first holding clocks using the non-overlap signal to generate second holding clocks that do not overlap each other, applies sampled threshold voltages of the drive thin film transistors of the pixels to an output node in response to the second holding clocks, and discharges the output node in the overlap period in response to the non-overlap signal.

2. The OLED display of claim 1, further comprising:

an analog-to-digital converter (ADC) that converts the threshold voltages of the drive thin film transistors input through the output node into digital threshold voltages; and a memory that stores the digital threshold voltages and location information of the digital threshold voltages;

wherein the timing controller controls display data using the digital threshold voltages corresponding to location information of the display data received from the outside based on information stored in the memory.

3. The OLED display of claim 1, wherein the sample and hold block includes:

a sampling switch array including a plurality of sampling switches that are switched on in response to a sampling clock, the sampling switch array sampling the threshold voltages of the drive thin film transistors using the sampling switches;

a shift register array including a plurality of cascade-connected stages, the shift register array generating the first holding clocks using the plurality of cascade-connected stages;

an overlap prevention unit that performs an AND operation on the non-overlap signal and the first holding clocks to generate the second holding clocks;

a holding switch array including a plurality of holding switches that are switched on in response to the second holding clocks, the holding switch array sequentially outputting the sampled threshold voltages of the drive thin film transistors to the output node using the holding switches; and a discharging unit that discharges charges remaining in the output node in the overlap period in response to the non-overlap signal.

4. The OLED display of claim 3, wherein the overlap prevention unit includes a plurality of AND elements each connected between the shift register array and the holding switch array.

5. The OLED display of claim 3, wherein the discharging unit includes:

a phase inversion unit that inverts a phase of the non-overlap signal; and a discharge switch that is connected between the common output node and a ground level voltage source and is controlled by an output of the phase inversion unit.

6. The OLED display of claim 3, wherein the non-overlap signal has a first logic level different from a level of the first holding clocks in a non-overlap period and has a second logic level identical with the level of the first holding clocks in the non-overlap period.

7. The OLED display of claim 6, wherein the discharge switch is turned on in response to the first logic level of the non-overlap signal.

8. The OLED display of claim 1, wherein each pixel includes one pair of data lines and one gate line group.

9. The OLED display of claim 1, wherein each gate line group includes four gate lines.

10. The OLED display of claim 1, wherein each pixel further includes four switch thin film transistors.

11. The OLED display of claim 3, wherein two drive thin film transistors connected in parallel between a cathode electrode of the organic light emitting diode and a low potential driving voltages source.

12. The OLED display of claim 11, wherein the sampling switch array simultaneously samples threshold voltages of one drive thin film transistors on 1 horizontal line during 1 frame period and sequentially performs a sampling operation during a first period including n frame periods, wherein n is a vertical resolution, wherein the sampling switch array simultaneously samples threshold voltages of the other drive thin film transistors on one horizontal line during one frame period and sequentially performs a sampling operation during a second period including n frame periods following the first period.

13. The OLED display of claim 12, wherein each pair of the plurality of pairs of data lines includes a first data line for driving the one drive thin film transistor and a second data line for driving the other drive thin film transistor, wherein the sampling switches of the sampling switch array are alternately connected to the first data lines and the second data lines each for n frame periods.

* * * * *